United States Patent [19]

Selvaggi

[11] Patent Number: 4,552,144

[45] Date of Patent: Nov. 12, 1985

[54] BRASSIERE

[76] Inventor: Victor E. Selvaggi, 11855 NE. 19 Dr., N. Miami, Fla. 33181

[21] Appl. No.: 619,568

[22] Filed: Jun. 11, 1984

[51] Int. Cl.[4] ..... A41C 3/00

[52] U.S. Cl. ..... 128/510

[58] Field of Search ..... 128/510, 508, 509

[56] References Cited

U.S. PATENT DOCUMENTS

| | | | |
|---|---|---|---|
| 3,306,299 | 2/1967 | Paramore | 128/510 |
| 3,411,508 | 11/1968 | Sayers | 128/510 |
| 3,465,754 | 9/1969 | Lockwood et al. | 128/510 |
| 3,998,231 | 12/1976 | Delet | 128/510 |

*Primary Examiner*—Doris L. Troutman

[57] ABSTRACT

An improved brassiere for use with a gown having a deep plunging neckline in the front and the rear and which includes a first and second brassiere cup and support means for the brassiere cup which connect to the waistband and which support means includes a backstrap extending upwardly from the waistband at spaced locations over the shoulders and, a plurality of downwardly extending members from the backstrap connecting to the brassiere cups and to the waistband and wherein fasteners are provided to connect the backstrap to the support structure adjacent the brassiere cups and the waistband is adapted to be opened and closed as desired either in the front or the rear.

4 Claims, 1 Drawing Figure

BRASSIERE

FIELD OF THE INVENTION

This invention relates to brassieres.

BACKGROUND OF THE INVENTION

In the past there have been numerous types of brassieres and this invention is of an improved brassiere which is of the type which provides substantial support for the breasts of a wearer of a gown which has a deep plunging neckline in the front and also in the back but wherein lateral extending portions between the cups of the brassiere are not to be seen above the waistline and which structure, notwithstanding, provides substantial breast support to a wearer.

OBJECTS OF THE INVENTION

It is an object of this invention to provide a brassiere of the type which is useful to be worn with a gown having a deep plunging neckline of the type which plunges so low that the side edges of the neckline do not meet except at about the waistband of the garment and wherein the brassiere includes a waistband and a support structure for brassiere cups wherein adequate support is provided without the necessity of connecting the brassiere cups together by lateral structure such as lateral support bands which would be visible since they would be above the waistline.

It is a general object of this invention to provide an improved brassiere of the type described which is simple and inexpensive to construct and which is well adapted for use in wearing gowns of high fashion which often have deep plunging necklines and wherein the brassiere and more particularly, lateral portions thereof connecting the cups do not show.

It is also an object of this invention to provide a brassiere of the type described in the preceding paragraph and wherein the back of the gown may also be a deep plunging type without revealing or showing the brassiere.

In accordance with these and other objects which will become apparent hereinafter, the instant invention will now be described with reference to the accompanying drawings in which:

BRIEF DESCRIPTION OF THE DRAWING

The drawing illustrates the improved brassiere.

DESCRIPTION OF THE PREFERRED EMBODIMENTS

Figure 1:
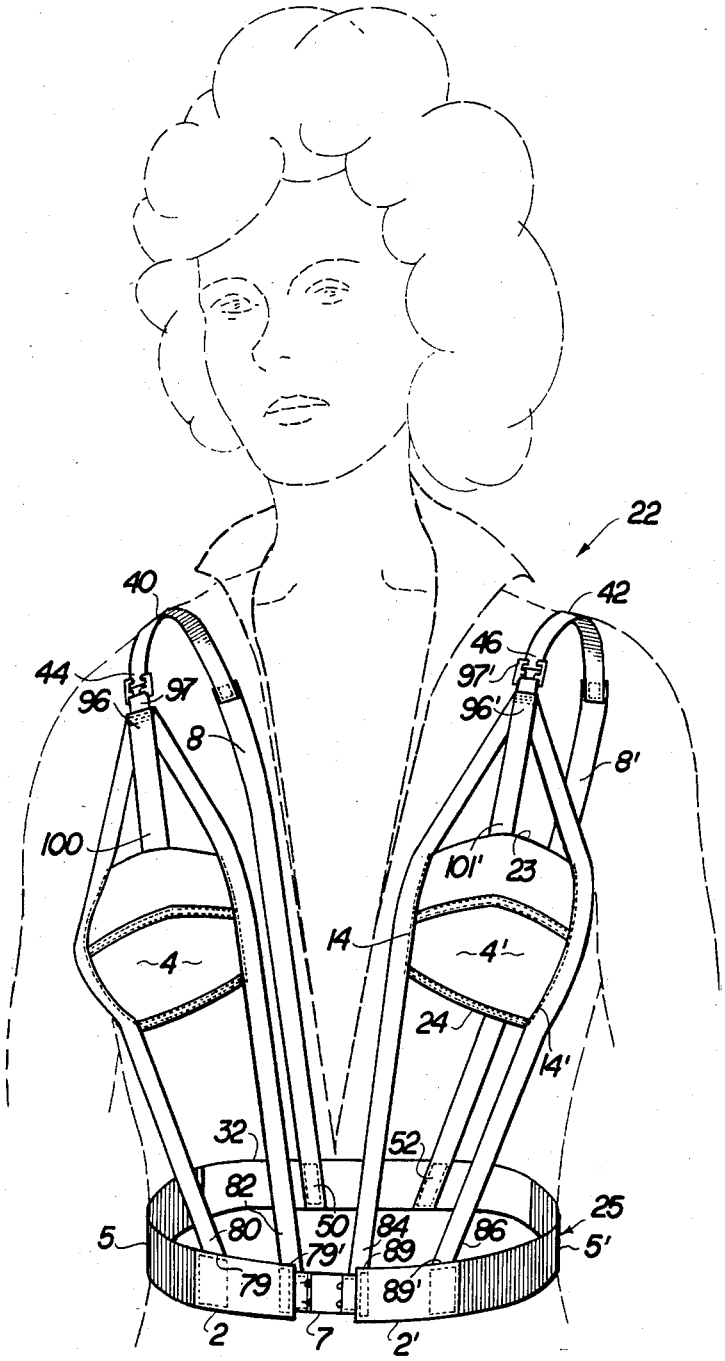

Referring to the drawing, there is shown a brassiere generally designated by the numeral 22 which is of the type especially for use with a gown having a deep plunging neckline which meets at about the waistband of the garment. It is desired that the brassiere provide support but that it not have a connecting link above the waistline between the two brassiere cups, since this would be exposed and the idea is that it not be seen with the lowcut garment. The brassiere it is seen includes a first and a second brassiere cup 4 and 4'. Each of the brassiere cups has a side edge, 14 and 14' and a top and bottom edge 23 and 24 respectively. The brassiere also includes a waistband generally designated by the numeral 25 which has a front portion 2, 2' and a rear portion 32 and a first and second side portion 5 and 5'. The waistband has a first and second end which are secured by fastening means 7 which may be of any suitable type, such as hook and eye for hooked up engagement about the waist of a wearer, preferably in the front as shown. The brassiere includes a first and second backstrap 8 and 8' each having an upper end 40 and 42 which preferably are of a length to extend over the shoulder to a terminal end 44, 46. Each of the backstraps has a lower end 50 and 52 which are connected to the back portion of the waistband 32 by suitable means such at stiching.

Each of the brassiere cups includes a support means for each cup. Each of the support means includes a pair of straps 80 and 82 and 84 and 86 which have a lower portion which extends substantially vertically from the side edges of the associated brassiere cup to a terminal end attached to the front portion of the waistband below the brassiere strap as at 79, 79', 89 and 89'. These straps extend upwardly converging towards one another as shown to a zone of juncture 96 and 96' from which a tab 97 97' extends and is provided with a fastener means for suitable adjustable hooked-up engagement with the distal ends of the backstrap as shown. In the preferred embodiment, extending from the upper edge 23 of each of the brassiere cups, there is provided a strap 101 and 101' to add stability and further support. In a preferred embodiment, the side portions of the waistband may be of elastic material.

In the preferred embodiment, the straps are of ribbon material, which may be that which is known commercially under the name Gros Grain Ribbon No. 1, which is about 1 and ½ inches in lateral width, this size being preferred for the backstraps as well as the front straps, while the waistband may be of similar sized material. The elastic at the side of the waistband may be of about ⅜ inches in dimension and preferably the lower edge of each brassiere cup is provided with material known as boning material and the fastening means for the backstrap and the front straps may be a slide buckle and tape-type commonly used in the field.

While the ribbons and the elastic widths of the preferred embodiment are set forth herein for a particularly preferred embodiment, it is recognized that larger or smaller or different size shapes and configurations may be used to satisfy the designer's inclination.

In use, the brassiere cups and ribbons are stitched together with the waistband so that there is provided a strong, durable highly useful device for the purposes set forth more fully hereinbefore.

While the foregoing invention has been described in a preferred embodimment, it is recognized that departures may be made within the spirit and scope of this invention which is, therefore, not to be limited except as set forth in the claims which follow in accordance with the doctrince of equivalents.

I claim:

1. For use with a gown of the type having deep plunging neckline to meet at about the waistband of the garment, an improved brassiere 22 comprising:

a first and second brassiere cup 4, 4' each having a pair of generally vertical side edges 14, 14' an a top and bottom edge, a waistband 25 having a front portion 2, 2', a rear portion 32, and a first and second side portion 5, 5', connecting the front and rear portions together; said waistband having a first and second end and fastening means 7 on said ends for mutual intercooperation to connect the same together to form said band, said fastening means being normally beneath and between said cups, a first and second back strap, each having an upward end and a lower end, the lower end of each being secured to the rear portion of said waistband at spaced locations with respect to one another and each location being substantially equispaced from the adjacent side portion, a brassiere cup support means for each cup, each support means having, a pair of straps extending substantially vertically from the side edge of the front portion of the waistband below said brassiere cup, and a first and second generally upwardly extending strap from the top edge adjacent one of the side edges of the cup and converging to a distal end zone, means on the distal end zone to attach to the upper end of the back strap.

2. The device as set forth in claim 1 wherein said support means includes a strap connected at one end to the top edge of each of said cups and to the backstrap.

3. The device as set forth in claim 1 wherein said fastening means are in the front portion.

4. The device as set forth in claim 1 wherein said waistband side portions are of elastic material.

* * * * *